United States Patent [19]

Toya et al.

[11] Patent Number: 4,552,828

[45] Date of Patent: Nov. 12, 1985

[54] DIRECT POSITIVE SILVER HALIDE PHOTOGRAPHIC EMULSION

[75] Inventors: Ichizo Toya; Yuji Mihara; Haruo Takei, all of Kanagawa, Japan

[73] Assignee: Fuji Photo Film Co., Ltd., Kanagawa, Japan

[21] Appl. No.: 527,922

[22] Filed: Aug. 30, 1983

[30] Foreign Application Priority Data

Aug. 30, 1982 [JP] Japan ..... 57-150581

[51] Int. Cl.[4] ..... G03C 1/40; G03C 5/54; G03C 1/16; G03C 1/28

[52] U.S. Cl. ..... 430/217; 430/547; 430/560; 430/566; 430/577; 430/598

[58] Field of Search ..... 430/217, 577, 547, 566, 430/560, 598

[56] References Cited

U.S. PATENT DOCUMENTS

| | | | |
|---|---|---|---|
| 2,430,558 | 11/1947 | Carroll et al. | 430/577 |
| 2,977,229 | 3/1961 | Jones | 430/577 |
| 4,173,483 | 11/1979 | Habu et al. | 430/577 |
| 4,276,364 | 6/1981 | Leone | 430/217 |

FOREIGN PATENT DOCUMENTS 55-35386 3/1980 Japan .

*Primary Examiner*—Richard L. Schilling

*Attorney, Agent, or Firm*—Sughrue, Mion, Zinn Macpeak & Seas

[57] ABSTRACT

A direct positive silver halide photographic emulsion which is able to provide a high maximum density and a low minimum density and having a high developing progress. The emulsion contains at least one of the sensitizing dyes represented by following general formula I and at least one of the compounds represented by general formula II:

Formula I:

Formula II:

The substituents are defined in the specification.

30 Claims, No Drawings

DIRECT POSITIVE SILVER HALIDE PHOTOGRAPHIC EMULSION

FIELD OF THE INVENTION

This invention relates to silver halide photographic emulsions. Specifically, the invention relates to direct positive silver halide photographic emulsions and more particularly to internal latent image type silver halide photographic emulsions useful for obtaining direct positive images by processing with a surface developer in the presence of a fogging agent. Furthermore, the invention relates to spectrally sensitized silver halide photographic emulsions useful for obtaining direct positive images by the aforesaid process.

BACKGROUND OF THE INVENTION

Processes of obtaining direct positive images by processing internal latent image type silver halide photographic emulsions with a surface developer in the presence of a fogging agent as well as silver halide photographic emulsions and photographic materials used for such processes are disclosed in, for example, U.S. Pat. Nos. 2,456,953; 2,497,875; 2,497,876; 2,588,982; 2,675,318; 3,227,552; and 2,592,250; British Pat. Nos. 1,151,363; and 1,011,062; Japanese Patent Publication No. 29,405/'68, etc. By an internal latent image type silver halide photographic emulsion is meant a silver halide photographic emulsion having photosensitive nuclei mainly in the inside of silver halide grains and forming latent images mainly in the inside of the silver halide grains caused by the internal photogsensitive nuclei. A photographic emulsion composed of such silver halide grains is not substantially developed by a surface developer.

By the term "surface developer" is meant a developer which develops a surface latent image of silver halide grains but substantially does not develop an internal latent image. A surface developer or the composition thereof usually contains a conventional silver halide developing agent but must not substantially contain a silver halide solvent (e.g., a water-soluble thiocyanate, a water-soluble thiosulfate, ammonia, etc.) used for forming internal latent images. For the surface developer, it is preferred to use slightly excessive amount of halide or the excessive halide can be incorporated in a silver halide emulsion as a halide-releasing compound. However, the use of a large amount of halide shall usually be avoided for preventing the substantial decomposition or dissolution of silver halide grains.

In the above-described process of obtaining a direct positive image, a fogging agent may be incorporated in a developer or may be incorporated in a silver halide photographic emulsion layer of a photographic material or other layer thereof.

In a silver halide photographic material, silver halide photographic emulsions are ordinary spectrally sensitized.

For employing the foregoing process of obtaining a direct positive image in the presence of a fogging agent in many application fields regarding photography, improvements of various photographic characteristics such as the improvement of photographic speed, the improvement of the maximum density (Dmax), the reduction of the minimum density (Dmin), the suppression of the occurrence of re-reversal images, etc. have been desired.

SUMMARY OF THE INVENTION

An object of this invention is to provide an internal latent image type direct positive silver halide photographic emulsion having the above-mentioned improved photographic characteristics.

A particular object of this invention is to improve the reversal property of an internal latent image type silver halide photographic emulsion in the process of containing a direct positive image by surface-developing the silver halide photographic emulsion in the presence of a fogging agent. That is, the object of this invention is to provide a direct positive silver halide photographic emulsion which is able to provide a high maximum density and a low minimum density, and having a high developing progress.

Other object of this invention is to provide a direct positive internal latent image type silver halide photographic emulsion giving a high maximum density and showing a high developing progress in a diffusion transfer process, in particular a dye diffusion transfer process for obtaining a direct positive image by surface-developing the internal latent image type silver halide photographic emulsion in the presence of a fogging agent.

The foregoing various objects of this invention have been attained by the direct positive silver halide photographic emulsion containing at least one of sensitizing dyes shown by following general formula I and at least one of compounds shown by following general formula II:

Formula I:

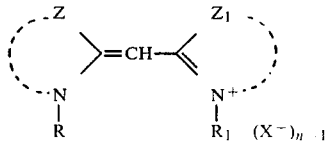

wherein Z and $Z_1$ each represents a non-metallic atomic group necessary for completing a benzoxazole nucleus, a benzothiazole nucleus, a benzoselenazole, a naphthoxazole nucleus, a naphthothiazole, a naphthoselenazole nucleus, a thiazole nucleus, a thiazoline nucleus, a pyridine nucleus, or a quinoline nucleus; R and $R_1$ each represents an alkyl group, a substituted alkyl group, or an allyl group; $X^-$ represents an acid anion; and n represents 1 or 2;

Formula II:

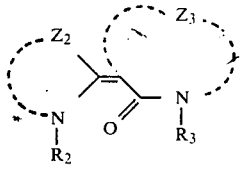

wherein $Z_2$ represents a non-metallic atomic group necessary for completing a thiazole nucleus, a thiazoline nucleus, a selenazole nucleus, a selanazoline nucleus, or pyrrolidine nucleus; $Z_3$ represents a non-metallic atomic group necessary for completing a rhodanine nucleus, a 2-thiohydantoin nucleus, a 2-thiooxazolidine-2,4-dione nucleus, or a 2-thioselenazolidine-2,4-dione nucleus; and $R_2$ and $R_3$ each represents a hydrogen atom, an alkyl group a substituted alkyl group, an aryl group, or an allyl group.

DETAILED DESCRIPTION OF THE INVENTION

Now, the compounds used in this invention will be explained in detail.

Z and $Z_1$ in general formula I each represents a non-metallic atomic group necessary for completing a heterocyclic nucleus which may be substituted with, for example, halogen (Cl, F, and Br), an alkyl group preferably having 1–4 carbon atoms, phenyl group, a phenyl group substituted with a substituent(s) such as those of the heterocyclic nucleous (Z and $Z_1$), an alkoxy group preferably 1–4 carbon atoms, an alkyl group substituted with a halogen (Cl, F, Br) and having 1–4 carbon atoms, hydroxy group and carboxy group. Heterocyclic nuclei include a benzoxazole nucleus (e.g., benzoxazole nucleus, 5-chlorobenzoxazole nucleus, 5-methylbenzoxazole nucleus, 5-bromobenzoxazole nucleus, 5-fluorobenzoxazole nucleus, 5-phenylbenzoxazole nucleus, 5-methoxybenzoxazole nucleus, 5-ethoxybenzoxazole nucleus, 5-trifluoromethylbenzoxazole nucleus, 5-hydroxybenzoxazole nucleus, 5-carboxybenzoxazole nucleus, 6-methylbenzoxazole nucleus, 6-chlorobenzoxazole nucleus, 6-methoxybenzoxazole nucleus, 6-hydroxybenzoxazole nucleus, 5,6-dimethylbenzoxazole nucleus, etc.), a benzothiazole nucleus (e.g., benzothiazole nucleus, 4-chlorobenzothiazole nucleus, 5-chlorobenzothiazole nucleus, 6-chlorobenzothiazole nucleus, 7-chlorobenzothiazole nucleus, 4-methylbenzothiazole nucleus, 5-methylbenzothiazole nucleus, 6-methylbenzothiazole nucleus, 5-bromobenzothiazole nucleus, 6-bromobenzothiazole nucleus, 4-phenylbenzothiazole nucleus, 5-phenylbenzothiazole nucleus, 5-methoxybenzothiazole nucleus, 6-methoxybenzothiazole nucleus, 5-ethoxybenzothiazole nucleus, 5-carboxybenzothiazole nucleus, 5-ethoxybenzothiazole nucleus, 5-fluorobenzothiazole nucleus, 5-trifluoromethylbenzothiazole nucleus, 5-chloro-6-methylbenzothiazole nucleus, 5-hydroxy-6-methylbenzothiazole nucleus, 5,6-dimethylbenzothiazole nucleus, etc.), a benzoselenazole nucleus (e.g., benzoselenazole nucleus, 5-chlorobenzoselenazole nucleus, 5-methoxybenzoselenazole nucleus, 5-hydroxybenzoselenazole nucleus, 5-phenylbenzoselenazole nucleus, etc.), naphthoxazole nucleus (e.g., naphtho[2,1-d]oxazole nucleus, naphtho[1,2-d]oxazole nucleus, naphtho[2,3-d]oxazole nucleus, 5-methoxynaphtho[1,2-d]oxazole nucleus, etc.), a naphthothiazole nucleus (e.g., naphtho[2,1-d]thiazole nucleus, naphtho[1,2-d]thiazole nucleus, naphtho[2,3-d]thiazole nucleus, 5-methoxynaphtho[1,2-d]thiazole nucleus, ·7-ethoxynaphtho[2,1-d]thiazole nucleus, 8-methoxynaphtho[2,3-d]thiazole nucleus, 8-chloronaphtho[1,2-d]thiazole nucleus, etc.), a naphthoselenazole nucleus (e.g., naphtho[2,1-d]selenazole nucleus, naphtho[1,2-d]selenazole nucleus, naphtho[2,3-d]selenazole nucleus, 8-chloronaphtho[1,2-d]selenazole nucleus, etc.), a thiazole nucleus (e.g., thiazole nucleus, 4-methylthiazole nucleus, 4-phenylthiazole nucleus, 4,5-dimethylthiazole nucleus, 4,5-diphenylthiazole nucleus, etc.), a thiazoline nucleus (e.g., thiazoline nucleus, 4-methylthiazoline nucleus, etc.), a pyridine nucleus (e.g., 2-pyridine nucleus, 4-pyridine nucleus, 5-methyl-2-pyridine nucleus, 3-methyl-4-pyridine nucleus, etc.), or a quinoline nucleus (e.g., 2-quinoline nucleus, 4-quinoline nucleus, 3-methyl-2-quinoline nucleus, 5-ethyl-2-quinoline nucleus, 6-methyl-2-quinoline nucleus, 8-fluoro-4-quinoline nucleus, 8-chloro-2-quinoline nucleus, 8-fluoro-2-quinoline nucleus, 6-methoxy-2-quinoline nucleus, 6-ethoxy-4-quinoline nucleus, 8-chloro-4-quinoline nucleus, 8-methyl-4-quinoline nucleus, 8-methoxy-4-quinoline nucleus, etc.).

R and $R_1$ in general formula I represent an alkyl group which may be substituted or unsubstituted and having 1 to 18 carbon atoms, preferably 1 to 8 carbon atoms in an alkyl moiety (e.g., methyl group, ethyl group, propyl group, butyl group, hexyl group dodecyl group, octadecyl group; an aralkyl group such as benzyl group, β-phenylethyl group, γ-phenylpropyl group, sulfophenethyl group, etc.; a hydroxyalkyl group such as 2-hydroxyethyl group, 3-hydroxypropyl group, etc.; a carboxyalkyl group such as 2-carboxyethyl group, 3-carboxypropyl group, 4-carboxybutyl group, etc.; and an aliphatic group having a sulfo group such as a sulfoalkyl group, e.g., 2-sulfoethyl group, 3-sulfopropyl group, 3-sulfobutyl group, 4-sulfobutyl group, 2-hydroxy-3-sulfoalkyl group, e.g., 2-hydroxy-3-sulfopropyl group, a sulfophenylalkyl group, a sulfoalkoxy alkyl group having 1–4 carbon atoms in alkoxy group, e.g., sulfoethoxyethyl group, etc.), or an allyl group.

$X^-$ represents an acid anion and n is 1 or 2. When the dye of general formula is in an intramolecular salt type (betaine) structure, n is 1. The acid anion is preferably such that it forms a salt which is soluble in water or an organic solvent. Examples of the acid anions include chloride ion, bromide ion, iodide ion, methyl sulfate ion, ethyl sulfate ion, p-toluenesulfate ion, etc.

Also, $Z_2$ in general formula II is a non-metallic atomic group necessary for completing a heterocyclic nucleus which may be substituted with, for example, halogen (Cl, F, and Br), an alkyl group preferably having 1–4 carbon atoms, phenyl group, a phenyl group substituted with a substituent(s) such as those of the heterocyclic nucleus ($Z_2$), an alkoxy group preferably having 1–4 carbon atoms, an alkyl group substituted with a halogen (Cl, F, Br) and having 1–4 carbon atoms, hydroxy group, nitro group, and carboxy group. Heterocyclic nuclei include a thiazole nucleus (e.g., thiazole nucleus, 4-methylthiazole nucleus, 4-phenylthiazole nucleus, 4,5-dimethylthiazole nucleus, 4,5-diphenylthiazole nucleus, etc.), a thiazoline nucleus (e.g., thiazoline nucleus, 4-methylthiazoline nucleus, 4-nitrothiazoline nucleus, etc.), a selenazole nucleus (e.g., selenazole, 4-methylselenazole nucleus, 4-nitroselenazole nucleus, 4-phenylselenazole nucleus, etc.), or a selenazoline nucleus (e.g., selenazoline nucleus, 4-methylselenazoline nucleus, 4-phenylselenazoline nucleus, etc.

$Z_3$ in general formula II represents a non-metallic atomic group necessary for completing a rhodanine nucleus, a 2-thiohydantoin nucleus, a 2-thiooxazoline-2,4-dione nucleus, or a 2-thioselenazolidine-2,4-dione nucleus. In these nuclei, a rhodanine nucleus and a 2-thiohydantoin nucleus are particularly preferred.

$R_2$ and $R_3$ in general formula II are a hydrogen atom, an alkyl group or a substituted alkyl group having 1 to 18 carbon atoms, preferably 1 to 8 carbon atoms in an alkyl moiety, e.g., methyl group, ethyl group, propyl group, butyl group, hexyl group, dodecyl group, octadecyl group; an aralkyl group such as benzyl group, β-phenylethyl group, γ-phenylpropyl group, etc.; a hydroxyalkyl group such as 2-hydroxyethyl group, 3-hydroxypropyl group, etc.; a carboxyalkyl group such as 2-carboxyethyl group; 3-carboxypropyl group, 4-carboxybutyl group, etc.; an aliphatic group having a sulfo group, e.g., a sulfoalkyl group such as 2-sulfoethyl group, 3-sulfopropyl group, 3-sulfobutyl group, and 4-sulfobutyl group, a hydroxy-sulfoalkyl group such as 2-hydroxy-3-sulfopropyl group, a sulfo alkoxyalkyl group having 1–4 carbon atoms in an alkoxy moiety such as sulfoethoxyethyl group, etc.; an aromatic group which may be substituted with, for example, an alkyl group having 1–4 carbon atoms, an alkoxy group having 1–4 carbon atoms and halogen atom (e.g., phenyl group, tolyl group, naphthyl group, methoxyphenyl group and chlorophenyl group, 2-pyridyl group, 3-pyridyl group); or an allyl group. In these groups, an alkyl group is preferred.

In the present invention a sulfo group and a carboxy group include $-SO_3^-$, $-SO_3H$, $-SO_3M$ and $-COO^-$, $-COOH$, $-COOM$ (M: for example, an alkali metal such as Na and K, an alkaline earth metal and a quaternary organic ammonium ion group such as $^+NH(CH_3)_3$.

The silver halide photographic emulsion of this invention is preferably the internal latent image type silver halide photographic emulsion capable of forming a direct positive image by performing a surface development in the presence of a fogging agent.

Practical examples of the sensitizing dye shown by general formula I are as follows. However, the invention is not limited to them.

A-1

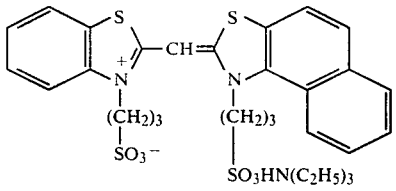

A-2

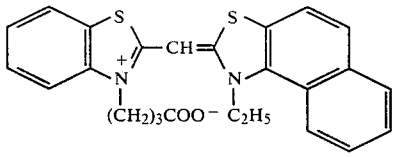

A-3

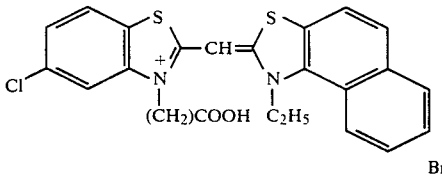

A-4

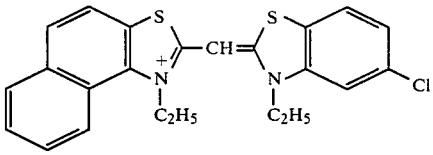

A-5

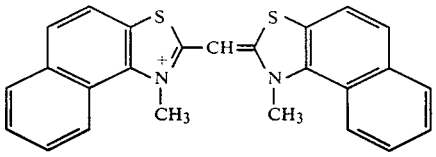

-continued

A-6

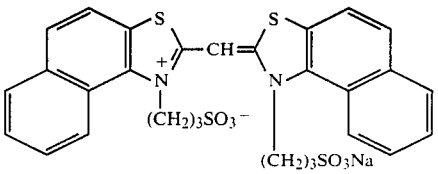

A-7

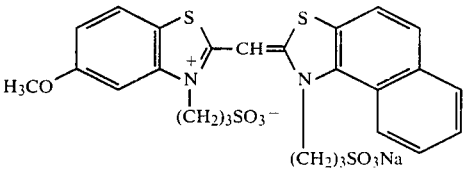

A-8

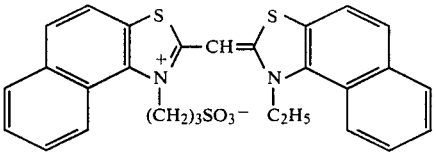

A-9

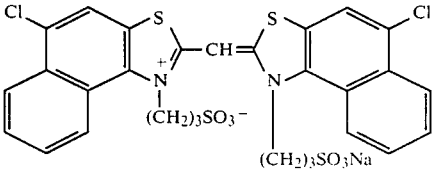

A-10

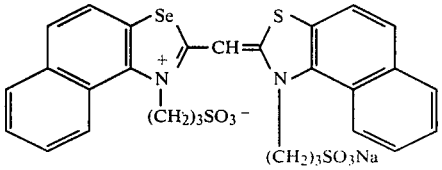

A-11

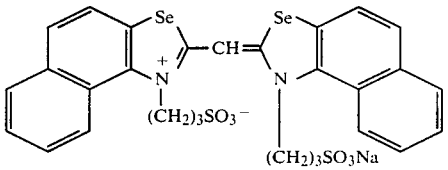

A-12

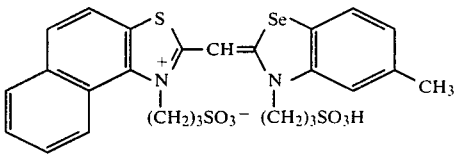

A-13

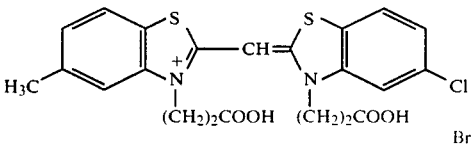

A-14

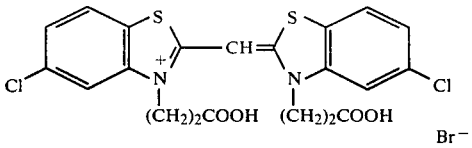

-continued
A-15
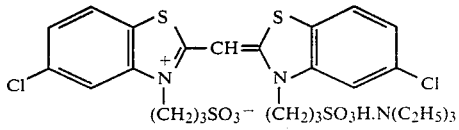
A-16
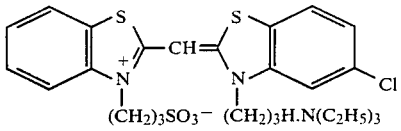
A-17
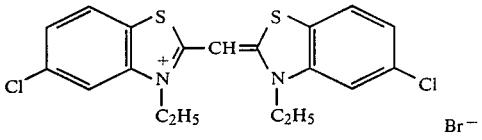
A-18
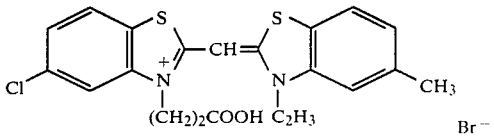
A-19
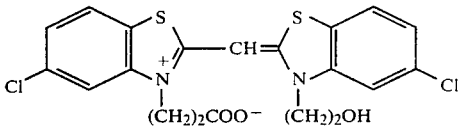
A-20
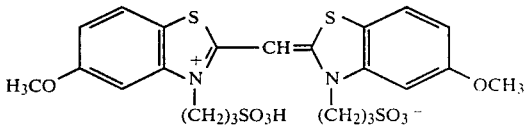
A-21
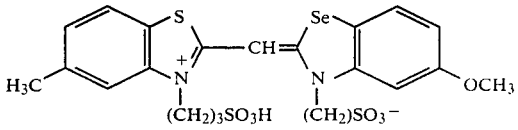
A-22
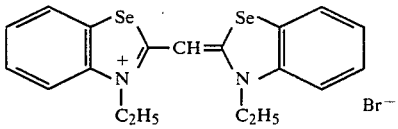
Practical examples of the compound shown by general formula II are as follows. However, the invention is not limited to them.
B-1
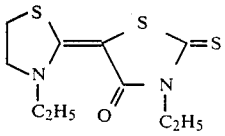
-continued
B-2
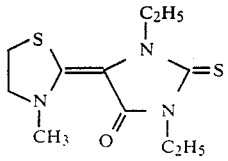
B-3
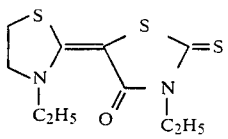
B-4
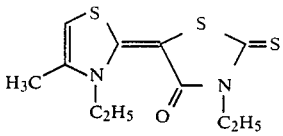
B-5
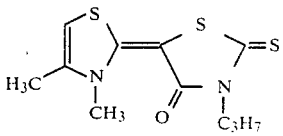
B-6
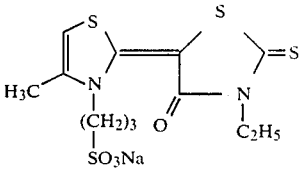
B-7
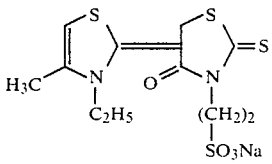
B-8
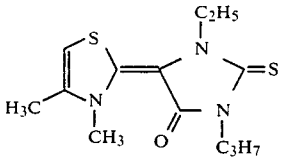
B-9
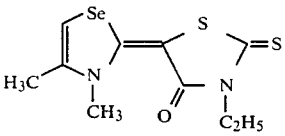
B-10
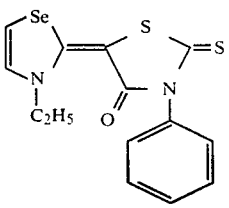

-continued

B-11

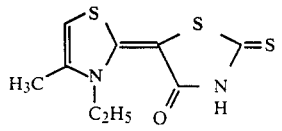

B-12

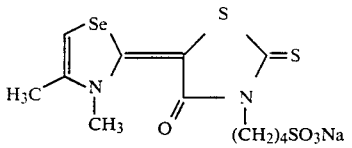

B-13

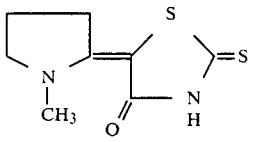

B-14

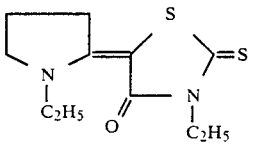

The sensitizing dyes shown by foregoing general formula I and the compounds shown by foregoing general formula II can be easily prepared by referring to the processes or referring to processes similar to the processes described in F. M. Hamer; "The Cyanine Dyes and Related Compounds", International Publishers, New York (1964).

The sensitizing dyes represented by general formula I used in this invention are used at a concentration similar to that in the case of using for ordinary negative silver halide emulsions. It is preferred to use the sensitizing dye at a concentration of about $1.0\times10^{-5}$ to about $5\times10^{-4}$ mole, particularly about $4\times10^{-5}$ to $2\times10^{-4}$ mole per mole of silver halide.

The optimum concentration of the sensitizing dye can be determined according to a known method, i.e., by a method of splitting into plural portions, incorporating the sensitizing dye in each portion of the silver halide emulsion at each different concentration, and measuring the spectral sensitivity of each portion.

The sensitizing dyes can be added to silver halide emulsions by the manner well known in the field of the art.

That is, the sensitizing dye can be directly dispersed in a silver halide emulsion or if first dissolved in a water-miscible solvent such as pyridine, methanol, ethanol, methyl cellosolve, acetone or a mixture of them diluted, as the case may be, with water, or dissolved in water and is added to a silver halide emulsion as the solution thereof. Also, a ultrasonic vibration may be applied in the case of dissolving the sensitizing dye. Other methods as described in, for example, Japanese Patent Publication Nos. 8231/'70; 23,389/'69; 27,555/'69; and 22,948/'69; West German Patent Application (OLS) No. 1,947,935; and U.S. Pat. Nos. 3,485,634; 3,342,605; 2,912,343, etc., can be used in this invention.

If necessary, the sensitizing dyes may be dissolved separately in proper solvents and the solutions may be added separately to a silver halide emulsion. Or, further, the sensitizing dyes may be dissolved in solvents having a same composition or in different solvents and the solution may be added to a silver halide emulsion as a mixture of them.

The compound shown by foregoing general formula II may be added to a silver halide emulsion by the manner as the case of adding the above-described sensitizing dye.

The silver halide photographic emulsion of this invention may further contain a dye having no spectral sensitizing action by itself or a material which does not substantially absorb visible light and shows a super sensitization together with the foregoing sensitizing dye or dyes. Examples of such materials are aminostilbene compounds substituted by nitrogen-containing heterocyclic ring group (as described in, e.g., U.S. Pat. Nos. 2,933,390, and 3,635,721), aromatic organic formaldehyde consensation products (as described in, for example, U.S. Pat. No. 3,743,510), cadmium salts, azaindene compounds, etc. The combinations described in U.S. Pat. Nos. 3,615,613; 3,615,641; 3,617,295; and 3,635,721 are particularly advantageous.

For other silver halide emulsion layers than the silver halide photographic emulsion layers of this invention, the sensitizing dyes described in, for example, Japanese Patent Application (OPI) Nos. 135,528/'76; 16,223/'77; 10,423/'78; 148,419/'76; 9,522/'78, etc., solely or as a combination of them.

The addition amount of the compound shown in general formula II used in this invention depends upon the desired effect of this invention but is usually about $1.0\times10^{-5}$ to about $5\times10^{-4}$ mole, preferably about $4\times10^{-5}$ to about $2\times10^{-4}$ mole per mole of silver halide. The proper molar ratio of the amount of the compound to the sensitizing dye can be determined by testing using a conventional method. The ratio is usually 1/10 to 10.

Examples of the silver halide used for the silver halide photographic emulsions of this invention are silver bromide, silver iodide, silver chloride, silver chlorobromide, silver bromoiodide, silver chlorobromo-iodide, etc. The preferred silver halide emulsion in this invention contains at least 50 mole% silver bromide and the most preferred silver halide emulsion in this invention is a silver bromide emulsion and a silver bromoiodide emulsion containing, in particular, not more than 10 mole% silver iodide.

An internal latent image type silver halide emulsion is a silver halide emulsion mainly forming a latent image in the inside of silver halide grains and is discriminated from silver halide grains mainly forming a latent image on the surface of the silver halide grains. Such internal latent images are disclosed by Davey et al. in U.S. Pat. No. 2,592,250, etc. The internal latent image type silver halide emulsion can be more clearly defined by the fact that the maximum density obtained by developing with an "internal" developer is higher than the maximum density obtained by developing a "surface" developer.

That is, the maximum density obtained by coating the internal latent image type silver halide emulsion suitable for this invention on a transparent support, exposing the photosensitive material thus formed for a definite time of 0.01 sec. to 1 sec., developing the material in an internal type developer having following developer composition A at 20° C. for 3 minutes, and measuring the maximum density by an ordinary photographic density measuring method is at least 5 times higher than the maximum density obtained in the case of developing the photosensitive material prepared as above and exposed by the same manner as above in a surface developer having following developer composition B at 20° C. for 4 minutes. In the preferred internal latent image type silver halide emulsion, the maximum density obtained by developing in developer A is over 10 times the maximum density obtained by developing in developer B.

The useful internal latent image type silver halide emulsions suitable for the objects of this invention are described in foregoing U.S. Pat. No. 2,592,250 as well as West German Patent Application (OLS) Nos. 2,308,239 and 2,416,814; British Pat. No. 1,027,146; U.S. Pat. Nos. 3,206,313; 3,511,662; 3,447,927; 3,737,313; 3,271,157; 3,317,322; 3,761,266; 3,761,267; 3,761,276; 3,850,637; 3,923,513, 3,854,949, 4,395,478, Japanese Patent Application (OPI) No. 108,532/'83, etc., although the silver halide emulsions used in this invention are not limited to them.

Developer A:
Hydroquinone: 15 g
Monomethyl-p-aminophenol sesquisulfate: 15 g
Sodium sulfite: 50 g
Potassium bromide: 10 g
Sodium hydroxide: 25 g
Sodium thiosulfate: 20 g
Water to make: 1 liter.
Developer B:
p-Oxyphenylglycine: 10 g
Sodium carbonate: 100 g
Water to make: 1 liter The invention is useful for an internal latent image type silver halide emulsion used for a photographic process of obtaining a direct positive image by surface developing the image-exposed silver halide emulsion layer in the presence of a fogging agent.

However, the effect of this invention is also obtained even in a process of obtaining a direct positive image by applying overall exposure (by flash light, etc.), after the imagewise exposure of the internal latent image type silver halide emulsion layer, during developing the emulsion layer in the surface developer.

The fogging agent used in this invention is a material which acts during development or pre-bath processing to form preferentially surface development nuclei to a silver halide emulsion having no internal latent image (i.e., internal development nuclei), whereby the silver halide grains become developable by a surface developer and it is considered that a fogging agent having almost no action of newly forming surface development nuclei to silver halide grains already having internal latent images (internal development nuclei) is preferred.

Examples of the fogging agent used in this invention are hydrazines described in U.S. Pat. Nos. 2,588,982 and 2,568,785, hydrazide and hydrazones described in U.S. Pat. No. 3,227,552, and hydrazone quaternary salts described in U.S. Pat. No. 3,615,615, etc., and they may be used as a combination thereof.

Preferred examples of the fogging agent used in this invention are the hydrazines and the hydrazone quaternary salts.

The amount of the fogging agent used can be adjusted over a wide range according to desired result. When the fogging agent is incorporated in a photographic material, the concentration of the fogging agent is 50 to 15,000 mg per mole of Ag, preferably 300 to 6,000 mg per mole of Ag. On the other hand, when the fogging agent is incorporated in a developer, the amount of the fogging agent is about 0.05 to 5 g, preferably 0.1 g to 1 g per liter of the developer. When the fogging agent is incorporated in a photographic layer of a photographic material, it is effective for the purpose of it to render the fogging agent non-diffusible.

The silver halide emulsion of this invention may further contain a dye image-forming coupler. Or, the silver halide emulsion layer of this invention may be developed in a developer containing a dye image-forming coupler. When the coupler is incorporated in the silver halide emulsion of this invention, it can be incorporated by a known method. For example, the methods described in U.S. Pat. Nos. 1,055,155; 1,102,028; 2,186,849; 2,322,027; and 2,801,171.

In this invention, a developing agent such as a polyhydroxybenzene, an aminophenol, a 3-pyrazolidone, etc., may be incorporated in the silver halide emulsion or in a photographic layer other than a silver halide layer in the photographic material. When the photographic material is a film unit type a developing agent may be incorporated in a rupturable container containing a processing composition. Also, in this invention, the silver halide photographic emulsions may be non-hardened ones or may contain a tanning developing agent such as hydroquinone, catechol, etc.

The internal latent image type silver halide photographic emulsions of this invention can be used for various uses but are particularly advantageously used as silver halide emulsions for direct positive type photographic materials, silver halide emulsions for multilayer reversal color photographic materials, and silver halide emulsions for multilayer color diffusion transfer process.

The silver halide photographic emulsion of this invention can be also used for obtaining a desired transferred image on an image-receiving layer after proper development processing by associating with a diffusion transfer dye image-providing material capable of releasing a diffusible dye corresponding to the development of the silver halide emulsion. As such diffusion transfer dye image-providing materials, many materials are known as disclosed in, for example, U.S. Pat. Nos. 3,227,551; 3,227,554; 3,443,939; 3,443,940; 3,658,524; 3,698,897; 3,725,062; 3,728,113; 3,751,406; 3,929,760; 3,931,144; 3,932,381; 3,928,312; 4,013,633; 3,932,380; 3,954,476; 3,942,987; and 4,013,635; U.S. Patent Publication No. B 351,673; British Pat. Nos. 840,731; 904,364; and 1,038,331; West German Patent Application (OLS) Nos. 1,930,215; 2,214,381; 2,228,361; 2,317,134; and 2,402,900; French Pat. No. 2,284,140; Japanese Patent Application (OPI) Nos. 113,624/'76 (corresponding to U.S. Pat. No. 4,055,428) and 104,343/'76; and Japanese Patent Application Nos. 64,533; '77; 58,318/'77, etc. In these materials, dye image-providing materials of the type that the materials are originally non-diffusible but are cleaved after causing the oxidation reduction reaction with the oxidation product of a developing agent to release diffusible dyes (hereinafter, are referred to as DRR compounds) are preferred.

Preferred DRR compounds used together with the silver halide photographic emulsions of this invention are the DRR compound having an o-hydroxyarylsulfamoyl group as described in foregoing Japanese Patent Application (OPI) No. 113,624/'76 and the DRR compound having a redox mother nucleus as described in Japanese Patent Application (OPI) No. 149,328/'78.

Practical examples of the DRR compounds are, in addition to those described in the foregoing patent specifications or specifications of the patent applications, such magenta dye image-forming materials as 1-hydroxy-2-tetramethylenesulfamoyl-4-[3-methyl-4'-(2''- hydroxy-4''-methyl-5''-hexadecyloxyphenylsulfamoyl)-phenylazo]-naphthalene, such yellow dye image-forming materials as 1-phenyl-3-cyano-4-(3'-[2''-hydroxy-4''-methyl-5''-(2''',4'''-di-t-pentylphenoxyacetamino)-phenylsulfamoyl]phenylazo-5-pyrazolone.

For developing the photograhic materials containing the silver halide photographic emulsions of this invention, various known developing agents can be used. That is, there are polyhydroxybenzenes such as hydroquinone, 2-chlorohydroquinone, 2-methylhydroquinone, catechol, pyrogallol, etc.; aminophenols such as p-aminophenol, N-methyl-p-aminophenol, 2,4-diaminophenol, etc.; 3-pyrazolidone such as 1-phenyl-3-pyrazolidone, 4,4-dimethyl-1-phenyl-3-pyrazolidone, 5,5-dimethyl-1-phenyl-3-pyrazolidone, etc.; and ascorbic acids. They can be used solely or as a combination of them. Also, for obtaining a dye image in the presence of a dye-forming coupler, an aromatic primary amine developing agent, preferably a p-phenylenediamine series developing agent can be used. Practical examples of the developing agent are 4-amino-3-methyl-N,N-diethylaniline hydrochloride, N,N-diethyl-p-phenylenediamine, 3-methyl-4-amino-N-ethyl-N-β(methanesulfoamido)ethylaniline, 3-methyl-4-amino-N-ethyl-N-(β-sulfoethyl-)aniline, 3-ethoxy-4-amino-N-ethyl-N-(β-sulfoethyl)aniline, 4-amino-N-ethyl-N-(β-hydroxyethyl)aniline, and the like. Such a developing agent may be incorporated in an alkaline processing coposition (processing element) or may be incorporated in a proper layer of a photosensitive element.

In the case of using the DRR compound in this invention, any silver halide developing agent which can cross oxidize the DRR compound can be used.

The developer used in this invention may contain sodium sulfite, potassium sulfite, ascorbic acid, reductions (e.g., piperidinohexose reduction, etc.), etc., as a preservative.

The photographic material containing the silver halide photographic emulsions of this invention can provide direct positive images by developing using a surface deverloper. The development by the surface developer is induced substantially by a latent image or fogging nucleus existing at the surface of silver halide grains. It is preferred that the developer does not contain a silver halide solvent but if the internal latent image does not substantially contribute until the development by the surface development center of silver halide grains is finished, the developer may contain a silver halide solvent (e.g., a sulfite) to some extent.

The developer may also contain sodium hydroxide, potassium hydroxide, sodium carbonate, potassium carbonate, trisodium phosphate, sodium metaborate, etc., as an alkalifying agent and a buffer. The content of these agents is selected so that the pH of the developer becomes 10 to 13, preferably 11 to 12.5.

The developer may also contain a color development accelerator such as benzyl alcohol, etc. Also, it is advantageous that the developer contains a benzimidazole such as 5-nitrobenzimidazole, etc.; a benztriazole such as benztriazole, 5-methyl-benztriazole, etc., which are usually used as an antifiggant, for further reducing the minimum density of the direct positive images.

The photographic material containing the silver halide photographic emulsions of this invention can be processed by a viscous developer.

The viscous developer is a viscous composition containing processing compositions necessary for developing silver halide emulsions and forming diffusion transfer dye images. The solvent is mainly water and may contain a hydrophilic solvent such as methanol, methyl cellosolve, etc. The processing composition contains an alkali in an amount sufficient for maintaining the pH necessary for causing the development of silver halide emulsion layers and for neutralizing the acids (e.g., a hydrohalogenic acid such as hyrobromic acid, etc., and a carboxylic acid such as acetic acid, etc.) formed during the development and various steps of forming dye images.

As the alkali, hyroxides, salts (such as phosphates and carbonates) of alkali metal and alkaline earth metal, hydroxy organic ammonium compounds or amines such as lithium hydroxide, sodium hydroxide, potassium hydroxide, calcium hydroxide, tetramethyl-ammonium hydroxide, sodium carbonate, trisodium phosphate, diethylamine, etc., are used. In this case, it is preferred that the processing composition contains a caustic alkali at a concentration which provide a pH higher than about 12, particularly higher than 14 at room temperature. More preferably, the processing composition contains a hydrophilic polymer such as a high molecular weight polyvinyl alcohol, hydroxyethyl cellulose, sodium carboxymethyl cellulose, etc. Such a polymer is preferably used in such a manner that the viscosity of the processing composition becomes higher than 1 poise, preferably about 500 to about 1,000 poises at room temperature.

It is particularly advantageous in the case of a mono sheet type film unit that the processing composition further contains a light-absorbing material such as $TiO_2$, carbon black, a pH indicating dye, etc., for preventing the silver halide emulsion layers from being fogged by external light during processing and after processing and also a densensitizer as described in U.S. Pat. No. 3,579,333. Moreover, the processing composition may contain a development inhibitor such as benzotriazole, etc.

It is preferred that the foregoing processing composition is contained in a rupturable container as described in, for example, U.S. Pat. Nos. 2,543,181; 2,643,886; 2,653,732; 2,723,051; 3,056,491; 3,056,492; 3,152,515, etc.

When the photographic material containing the silver halide photographic emulsions of this invention for diffusion transfer photographic process, it is preferred that the photographic material be in a form of a film unit. The photographic unit, that is a film unit which can be processed by passing the film unit between a pair of juxtaposed pressing members is fundamentally composed of the following three elements:

(1) photosensitive element containing the silver halide photographic emulsions of this invention, (2) image-receiving element, and (3) processing element: having a means, such as a rupturable container, for releasing the alkaline processing composition in the inside of the film unit and containing a silver halide solvent.

A preferred embodiment of the photographic film unit is a unitary type of the aforesaid elements as disclosed in Belgian Pat. No. 757,959. According to the embodiment, an image-receiving layer, a substantially opaque light-reflecting layer (e.g., a $TiO_2$-containing layer and a carbon black-containing layer), and a photosensitive element composed of a single or plural silver halide photographic emulsion layers associated with DRR compounds are coated, in succession, on a transparent support and further a transparent cover sheet is disposed thereon in a face-to-face relationship. A rupturable container containing an alkaline processing composition containing an opacifying agent (e.g., carbon black) is disposed adjacent to the upermost layer of the photosensitive element and the transparent cover sheet.

The film unit is image-exposed through the transparent cover in a camera and in the case of withdrawing the film unit from the camera, the container is ruptured by means of pressing members to uniformly spread the processing composition (containing an opacifying agent) between the protective layer of the photosensitive element and the cover sheet, whereby the film unit is shaded and the development proceeds. It is preferred that the cover sheet comprises a support which is coated with a neutralizing layer and, if necessary, a neutralization speed controlling layer (timing layer), in this order.

Also, other useful unitary film units using the DRR compounds or diffusible dye-releasing couplers are described in U.S. Pat. Nos. 3,415,644; 3,415,645; 3,415,646; 3,647,487; and 3,635,707; West German Patent Application (OLS) No. 2,426,980, etc.

For the photographic materials containing the direct positive silver halide photographic emulsions of this invention, various kinds of colloids can be used as a vehicle or a binder.

Examples of the satisfactory colloids used for the purpose are hydrophilic colloids generally used in the field of photography, for example, polysaccharides such as gelatin, colloidal albumin, dextran, gum arabic, etc.; cellulose derivatives such as hydroxyethyl cellulose, etc.; synthetic resins such as polyvinyl compounds including polyvinyl alcohol derivatives, acrylamide polymer etc. The foregoing hydrophilic colloid may contain a hydrophobic colloid such as dispersed polymeric vinyl compound for improving the dimensional stability of the photographic materials. Proper examples of the hydrophobic colloid are the water-insoluble polymers of alkyl acrylate, alkyl methacrylate, acrylic acid, sulfoalkyl acrylate, sulfoalkyl methacrylate, etc.

The silver halide photographic emulsions of this invention may be coated on various supports together with other photographic compositions to provide photographic elements. The silver halide photographic emulsions may be coated on one surface or both surfaces of a support, preferably a transparent and/or flexible support. Typical examples of the support are a cellulose nitrate film, cellulose acetate film, polyvinyl acetal film, polystyrene film, polyethylene terephthalate film, and other polyester films as well as a glass sheet, a paper, a metal foil or sheet, a wood, etc. A support such as a paper coated or laminated with a polymer of $\alpha$-olefin, in particular a polymer of $\alpha$-olefin having two or more carbon atoms, such as polyethylene, polypropylene, ethylene butane copolymer, etc., gives good results.

The silver halide photographic emulsion layers and other photographic layers existing in the photographic elements prepared according to this invention can be hardened by a proper hardening agent. Examples of the hardening agent used for the purpose are an aldehyde hardening agent such aa formaldehyde, mucochloric acid, etc.; an aziridine hardening agent; a hardening agent composed of a dioxane derivative; an oxypolysaccharide such as oxy starch, etc.

Practical examples of the hardening agent used in this invention are described in "Product Licensing Index", Vol. 92, "Hardners" at page 108.

The silver halide photographic emulsion layers of this invention may further contain other additives, in particular those which are known to be useful for photographic emulsions, such as lubricants, stabilizers, speed increasing agents, light-absorptive dyes, plasticizers, etc.

The silver halide emulsions of this invention may further contain a coating aid. Examples of the coating aid used in this invention are described in "Product Licensing Index", Vol. 92, "Coating Aids" at page 108.

The silver halide emulsions of this invention can further contain a compound (e.g., potassium iodide) capable of releasing an iodide ion. In this invention, a desired image can be obtained using a developer containing an iodide ion.

In the case of preparing the photographic materials of this invention, it is frequently advantageous to use surface active agents or a mixture of them. Proper surface active agents include nonionic, ionic, and amphoteric surface active agents, such as, for example, polyoxyalkylene derivatives, amphoteric aminoacid despersing agents) including sulfobetaines), etc. Examples of these surface active agents are described in U.S. Pat. Nos. 2,600,831; 2,271,622; 2,271,623; 2,275,727; 2,787,604; 2,816,920; and 2,739,891, and Belgain Pat. No. 652,862.

The silver halide photographic emulsions of this invention may contain polyalkylene oxide or the derivatives thereof such as the ether, ester, amine, etc., thioether compounds, thiomorpholines, quaternary ammonium salts, urethane derivatives, urea derivatives, imidazole derivatives, 3-pyrazolidones, etc., for the purposes of increasing sensitivity, increasing contrast, and accelerating the development. Practical examples of these materials used for the purposes are described in, for example, U.S. Pat. Nos. 2,400,532; 2,423,549; 2,716,062; 3,617,280; 3,772,021; 3,808,003, etc.

The silver halide photographic emulsions of this invention may contain antifoggants and stabilizers. Practical examples of these compounds are described in "Product Licensing Index", Vol. 92, "Antifoggants and Stabilizers", at page 107.

According to this invention, in a process of obtaining a direct positive image by surface-developing internal latent image type silver halide photographic emulsion layers in the presence of a fogging agent, a direct positive image having the high maximum density and sufficiently low minimum density can be obtained at high developing progress.

Also, according to this invention, in a diffusion transfer process, in particular, a color diffusion transfer process for obtaining a direct positive image by surface-developing the internal latent image type silver halide photographic emulsion layers in the presence of a fogging agent, a direct positive image having the high maximum density can be obtained at a high development progress.

Furthermore, the effect of this invention becomes more remarkable by adding a development inhibitor such as benzotriazole to the internal latent image type silver halide emulsions as described in U.S. Pat. No. 2,497,917.

The feature of this invention is in the point of obtaining the high maximum density, the sufficiently low minimum density, and a high development progress by using the sensitizing dyes and the compounds of this invention in the case of performing the surface development in the presence of a fogging agent.

The invention will now be explained more practically by the following examples. However, the scope of the invention is not limited to those examples.

EXAMPLE 1

Each of two kinds of photosensitive element 1 and 2 was prepared by coating, in succession, the following layers on a transparent polyethylene terephthalate support.

(1) Dyeing layer containing 3.0 g/m$^2$ of the copolymer described in U.S. Pat. No. 3,898,088 having the repeating unit shown below at the following ratio

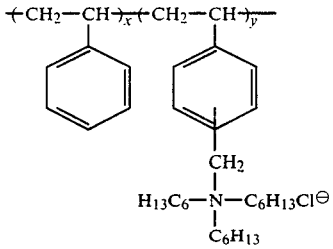

X:Y = 50:50 and 3.0 g/m$^2$ of gelatin.

(2) White reflecting layer containing 20 g/m$^2$ of titanium oxide and 20 g/m$^2$ of gelatin.

(3) Shading layer containing 2.7 g/m$^2$ of carbon black and 2.7 g/m$^2$ of gelatin.

(4) Layer containing 0.45 g/m$^2$ of the magenta DRR compound having the following formula, 0.10 g/m$^2$ of diethyl laurylamide, 0.0074 g/m$^2$ of 2,5-di-t-butylhydroquinone, and 0.76 g/m$^2$ of gelatin.

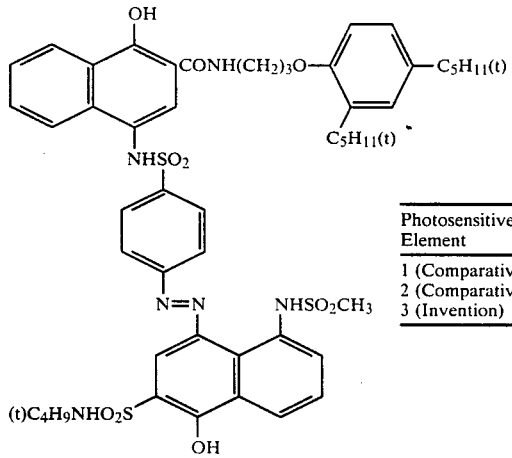

(5) Blue-sensitive internal latent image type direct positive silver iodobromide emulsion (silver iodide 2 mole%) layer containing an internal latent image type silver iodopromide emulsion (1.4 g/m$^2$ as silver amount), 1.9 mg/m$^2$ of the sensitizing dye (A-6), 0.5 mg/m$^2$ of the Compound B-4 or Comparative Compound C-1, 0.05 mg/m$^2$ of a fogging agent having the following formula, and 0.11 g/m$^2$ of sodium 5-pentadecyl-hydroquinone-2-sulfonate.

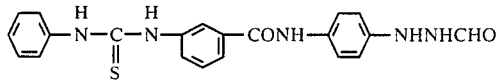

(6) Layer containing 0.94 g/m$^2$ of gelatin.

Each of the foregoing photosensitive elements 1, 2 and 3 was combined with the elements described hereinafter and then processed as shown below.

Processing composition:

1-Phenyl-4-methyl-4-hydroxymethyl-3-pyrazolidinone: 10 g
Methylhydroquinone: 0.18 g
5-Methylbenztriazole: 4.0 g
Sodium sulfite (anhydrous): 1.0 g
Carboxymethyl cellulose sodium salt: 40.0 g
Carbon black: 150 g
Potassium hydroxide (28% aq. soln.): 200 ml
Water: 500 ml.

The processing composition (0.8 g each) was filled in pressure rupturable containers.

Cover sheet:

A cover sheet was prepared by forming on a polyethylene terephthalate support an acid polymer layer (neutralizing layer) composed of 15 g/m$^2$ of polyacrylic acid (viscosity of about 1,000 c.p. as a 10% by weight aqueous solution) and a neutralization timing layer composed of 3.8 g/m$^2$ of acetyl cellulose (forming 39.4 g of acetyl group by the hydrolysis of 100 g of the acetyl cellulose) and 0.2 g/m$^2$ of a copolymer of styrene and maleic anhydride (mole ratio: styrene:maleic anhydride=about 60:40, molecular weight: about 50,000).

Processing step:

The aforesaid cover sheet was superposed on the above described photosensitive element and after exposing a color test chart from the cover sheet side, the foregoing processing composition was spread between both sheets in a thickness of 75 microns (spreading of the composition was performed by means of a press roller). The development was performed at 25° C. Thereafter, the green-filtered density of the image formed in the image-receiving layer was measured through the transparent support of the photosensitive element by means of a Macbeth reflection densitometer after one hour since the processing. The results are shown in Table 1.

TABLE 1

| Photosensitive Element | Sensitizing Dye | Amount (mg/m$^2$) | Compound | Amount (mg/m$^2$) | Dmax | Dmin |
|---|---|---|---|---|---|---|
| 1 (Comparative) | A-6 | 1.9 | none | — | 1.54 | 0.24 |
| 2 (Comparative) | A-6 | 1.9 | Compound C-1 | 0.5 | 1.14 | 0.25 |
| 3 (Invention) | A-6 | 1.9 | Compound B-4 | 0.5 | 1.70 | 0.25 |

As is clear from the above results, the photosensitive element 3 prepared using the silver halide emulsion of this invention shows higher Dmax than those of the photosensitive element 1 prepared by conventional manner and the photosensitive element 2 prepared using a merocyanine (Compound C-1 shown below) disclosed in Japanese Patent Application (OPI) No. 35,386/80 and sufficient low Dmin.

Compound C-1

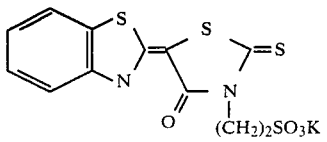

EXAMPLE 2

Each of photosensitive elements 4 to 9 was prepared by coating, in succession, the following layers on a transparent polyethylene terephthalate support.

(1) Dyeing layer having the same composition as that in Example 1.

(2) White reflecting layer having the same composition as that in Example 1.

(3) Shading layer having the same composition as that in Example 1.

(4) Layer containing 0.5 g/m$^2$ of the cyan DRR compound having the following formula, 0.25 g/m$^2$ of diethyllaurylamide, and 1.14 g/m$^2$ of gelatin.

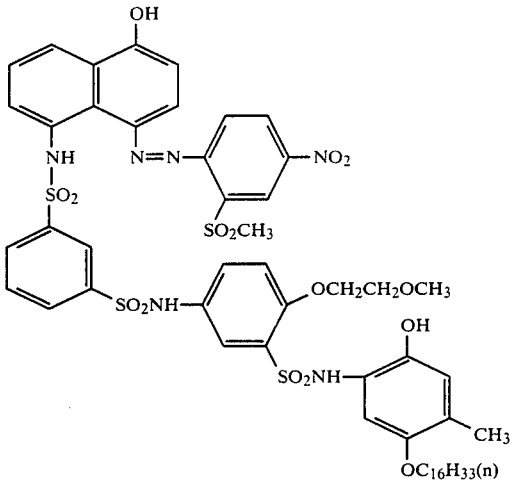

(5) Red-sensitive internal latent image type direct positive silver bromide emulsion layer containing an internal latent image type silver bromide emulsion (1.9 g/m$^2$ as silver amount), 1.5 mg/m$^2$ of a red-sensitive sensitizing dye having the following chemical formula, 0.07 g/m$^2$ of the fogging agent as in Example 1, and 0.13 g/m$^2$ of sodium 5-pentadecyl-hydroquinone-2-sulfonate.

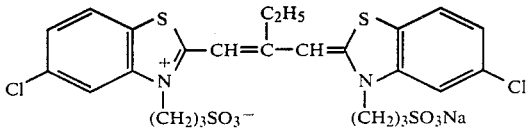

(6) Layer containing 2.6 g/m$^2$ of gelatin and 1.0 g/m$^2$ of 2,5-dioctylhydroquinone.

(7) Layer having the same composition as the layer (4) in Example 1 except that the layer contained the magenta DRR compound having the following formula.

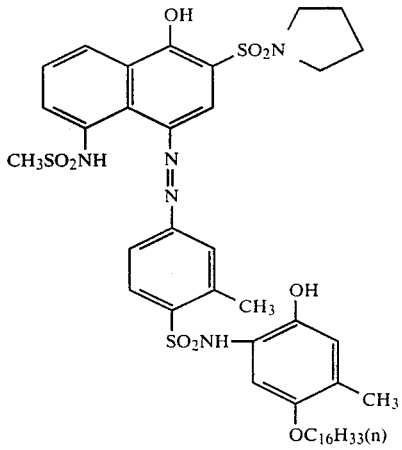

(8) Blue-sensitive internal latent image type direct positive emulsion layer having the same composition as in Example 1.

(9) Layer having the same composition as that of the aforesaid layer (6).

(10) Layer containing 0.78 g/m$^2$ of the yellow DRR compound having the following formula, 0.16 g/m$^2$ of diethyllaurylamide, 0.012 g/m$^2$ of 2,5-di-t-butylhydroquinone, and 0.78 g/m$^2$ of gelatin.

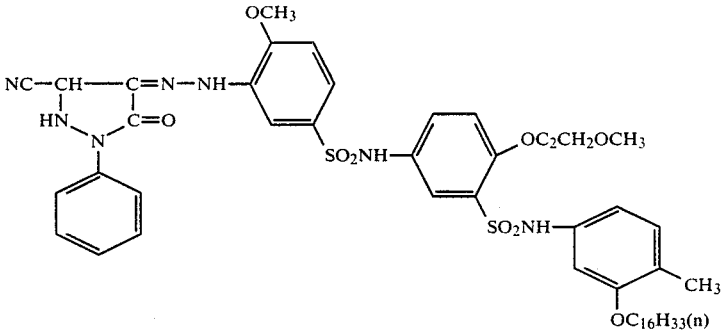

(11) Internatl latent image type direct positive silver bromide emulsion layer containing an internal latent image type silver bromide emulsion (2.2 g/m$^2$ as silver amount), sensitizing dyes (0.4 mg/m$^2$ of dye A-6 and 1.5 mg/m$^2$ of dye A-15), the compound selected from the compounds of general formula II and the following compound group, 0.08 mg/m$^2$ of the fogging agent as in Example 1, and 0.094 g/m$^2$ of sodium 5-pentadecylhydroquinone-2-sulfonate.

(12) Layer containing 0.94 g/m$^2$ of gelatin.

Processing solution:

Same as used in Example 1.

Cover sheet:

The cover sheet was prepared by coating, in succession, the following layers on a polyethylene terephthalate support.

(1) In 1 kg of 20% solution (solvent was a mixture of water and acetone at 3:1 by volume ratio) of a copolymer of acrylic acid and butyl acrylate (8:2 by mole ratio) having a mean molecular weight of 50,000 was dissolved 3.8 g of 5-(2-cyanoethylthio)-1-phenyltetrazole and the resultant solution was coated on the foregoing support at 110 g/m$^2$ to form a layer of about 20$\mu$ in thickness.

(2) In a mixed solvent of acetone and cyclohexanone (3:1 by volume ratio) were dissolved 55 g of cellulose acetate having an acetyl value of 52.1% (the amount of acetic acid released by the hydrolysis of the cellulose acetate was 0.521 g per gram of the sample) and 5 g of a copolymer of styrene and maleic anhydride (1:1 by mole ratio) having a mean molecular weight of 10,000 and the resultant solution was coated on the above-formed layer at 50 g/m$^2$ to form a layer of about 2.6$\mu$ in thickness.

(3) A solution (10% solid component) of a polymer latex prepared by emulsion polymerizing a mixture of styrene, butyl acrylate, and acrylic acid at 52:42:6 by weight ratio was coated on the aforesaid layer at 30 ml/m$^2$.

Processing step:

The aforesaid cover sheet was superposed on the above-mentioned photosensitive element and after performing image-exposure through a continuous gradation wedge from the cover sheet side, the aforesaid processing composition was spread between both sheets at a thickness of 80$\mu$. The spreading was performed by means of a press roller and the development was performed at 25° C. The photographic properties of the color positive images obtained in each sheet after processing are shown in Table 2.

TABLE 2

| Photosensitive Element | Compound | Amount (mg/m$^2$) | Dmax (B)* | Dmin (B) |
|---|---|---|---|---|
| 4 (Comparison) | none | — | 1.10 | 0.22 |
| 5 | Compound B-4 | 0.5 | 1.55 | 0.23 |
| 6 | Compound B-3 | 0.5 | 1.47 | 0.23 |
| 7 | Compound B-9 | 0.5 | 1.45 | 0.22 |
| 8 (Comparison) | Compound C-2 | 0.5 | 1.11 | 0.24 |
| 9 (Comparison) | Compound C-3 | 0.3 | 1.09 | 0.23 |

*B: Blue filtered.density

As is clear from the above results, it is understood that the photosensitive elements 5 to 7 prepared using the silver halide emulsions of this invention have higher Dmax than those of the comparison photosensitive element 4 prepared by the conventional manner and the photosensitive element 8 and 9 prepared using the silver halide emulsions containing merocyanine (following compounds C-2 and C-3) shown in Japanese Patent Application (OPI) No. 35,386/'80 and sufficiently low Dmin.

C-2

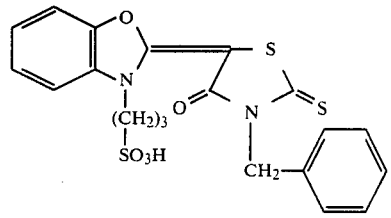

C-3

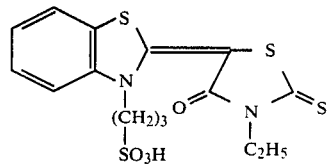

EXAMPLE 3

Each of photosensitive elements 10 to 13 was prepared by coating, in succession, the following layers on a transparent polyethylene terephthalate support.

(1) Dyeing layer having the same composition as that in Example 1.

(2) White reflecting layer having the same composition as that in Example 1.

(3) Shading layer having the same composition as that in Example 1.

(4) Layer containing the yellow DRR compound and gelatin as in the layer (10) in Example 2.

(5) Internal latent image type direct positive silver bromide emulsion layer containing the core/shell type internal latent image silver halide emulsion (2.2 g/m$^2$ as silver amount) prepared according to the method described in U.S. Pat. No. 3,761,276, sensitizing dyes (0.4 mg/m$^2$ of dye A-7 and 1.5 mg/m$^2$ of dye A-15), the compound selected from the compounds of general formula III, 0.07 mg/m$^2$ of fogging agent as in Example 1, and 0.094 g/m$^2$ of sodium 5-pentadecyl-hydroquinone-2-sulfonate.

(6) Layer containing gelatin as the layer (12) in Example 2.

Each of the photosensitive elements was processed as in Example 2 using the processing composition and the cover sheet as used in Example 1. The results are shown in Table 3.

TABLE 3

| Photosensitive Element | Compound | Amount (mg/m$^2$) | Dmax (B) | Dmin (B) |
|---|---|---|---|---|
| 10 | none | — | 1.90 | 0.24 |
| 11 | B-4 | 0.5 | 2.10 | 0.26 |
| 12 | B-5 | 0.5 | 2.11 | 0.29 |
| 13 | B-11 | 0.5 | 2.08 | 0.24 |

As is clear from the above results, it is understood that the photosensitive elements 11 to 13 prepared using the silver halide emulsions of this invention have higher Dmax than those of the comparison photosensitive element prepared by the conventional manner and sufficiently low Dmin.

EXAMPLE 4

Each of photosensitive elements 14 to 16 was prepared by coating, in succession, the following layers on a transparent polyethylene terephthalate support.

(1) Dyeing layer having the same composition as that in Example 1.

(2) White reflecting layer having the same composition as that in Example 1.

(3) Shading layer having the same composition as that in Example 1.

(4) Layer containing the yellow DRR compound and gelatin as the layer (10) in Example 2.

(5) Internal latent image type direct positive silver bromide emulsion layer containing an internal latent image type silver bromide emulsion (2.2 g/m$^2$ as silver amount), 0.4 mg/m$^2$ of Sensitizing dye A-7, 1.8 mg/m$^2$ of Sensitizing dye A-20, the compound selected from the compounds of general formula II, 0.07 mg/m$^2$ of the fogging agent as in Example 1, and 0.094 g/m$^2$ of sodium 5-pentadecylhydroquinone-2-sulfonate.

(6) Layer containing gelatin as the layer (12) in Example 2.

Each of the photosensitive elements was processed as in Example 1 using the processing composition and the cover sheet as in Example 1. The results are shown in Table 4.

TABLE 4

| Photosensitive Element | Compound | Amount (mg/m$^2$) | Dmax (B) | Dmin (B) |
|---|---|---|---|---|
| 14 | none | — | 1.96 | 0.24 |
| 15 | B-4 | 0.5 | 2.18 | 0.25 |
| 16 | B-2 | 0.5 | 2.13 | 0.25 |

As is clear from the above results, it is understood that by using the compounds of this invention, higher Dmax and sufficiently low Dmin are obtained.

EXAMPLE 5

Photosensitive material (I) was prepared by coating, in succession, the following layers on a polyethylene terephthalate film support imparted with shading property by kneading therein 12% by weight carbon black.

Photosensitive material (I):

(1) Layer containing 1.0 g/m$^2$ of the yellow dye-releasing redox compound having the following formula, 0.25 g/m$^2$ of N,N-diethyllaurylamide, and 1.0 g/m$^2$ of gelatin.

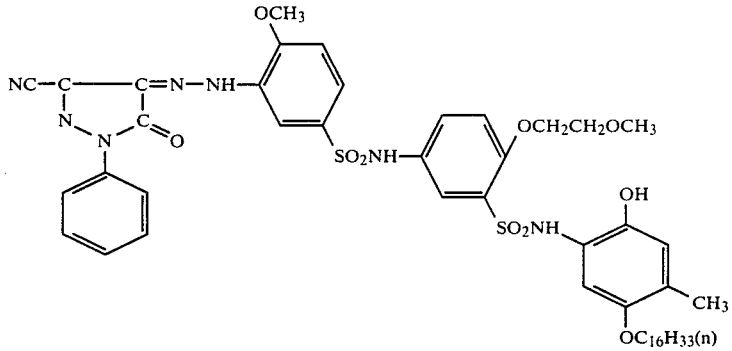

(2) Layer containing a blue-sensitive internal latent image type silver bromide emulsion (1.1 g/m$^2$ of gelatin and 1.4 g/m$^2$ of silver) containing 0.4 mg/m$^2$ of Sensitizing dye A-7 and 1.8 mg/m$^2$ of Sensitizing dye A-20; 10.015 g/m$^2$ of 1-actyl-2-[4-(2,4-di-t-pentylphenoxyacetamido)phenyl]-hydrazine; and 0.067 g/m$^2$ of sodium 2-pentadecylhydroquinone-5-sulfonate.

(3) Layer containing 1.0 g/m$^2$ of gelatin.

Photosensitive material (II):

Photosensitive material (II) was prepared by the same manner as the case of preparing Photosensitive material (I) except that the layer (2) further contained $2.0\times10^{-4}$ g/m$^2$ of Compound B-4.

Each of the foregoing photosensitive materials was imagewise exposed through a continuous wedge to tungsten light of 2854° K. converted into light of 4800° K. through a Davis-Gibson filter (the maximum exposure amount was 10 C.M.S.). The exposed films were processed with the following processing composition.

Processing composition:

Potassium hydroxide: 56 g

4-Hydroxymethyl4-methyl-1-p-tolyl-3-pyrazolidine: 6 g

5-Methylbenzotriazole: 5 g

Methylbenzotriazole: 0.2 g

Sodium sulfite: 0.8 g

Benzyl alcohol: 2 ml

Hydroxyethyl cellulose: 50 g

Water to make: 1 liter

On the other hand, an image-receiving sheet was prepared by coating, in succession, the following layers on a paper support the opposite surface of which was laminated with polyethylene containing carbon black for imparting shading property to the support.

(1) Neutralizing layer containing 17 g/m$^2$ of polyacrylic acid, 0.06 g/m$^2$ of N-hydroxysuccinimidobenzenesulfonate, and 0.5 g/m$^2$ of ethylene glycol and having a thickness of 7$\mu$.

(2) Timing layer formed on the above layer by coating cellulose acetate (acetyl value of 54) at a thickness of 2$\mu$.

(3) Timing layer formed thereon by coating a copolymer latex of vinylidene chloride and acrylic acid at a thickness of 4$\mu$.

(4) Image-receiving layer containing 4.0 g/m$^2$ of a styrene-N-vinylbenzyl-N,N,N-trihexylammonium chloride copolymer and 4.0 g/m$^2$ of gelatin.

(5) Separable layer containing 2.0 g/m$^2$ of phthalated gelatin.

The above-described processing composition was filled in a rupturable container and was uniformly spread between the foregoing cover sheet and the photosensitive material by passing the container between a pair of juxtaposed rollers at a thickness of 80$\mu$.

After 2 minutes since the spreading of the processing composition, the image-receiving sheet was separated from the photosensitive material and the density of the image formed in the image-receiving sheet was measured. The results are shown in Table 5.

TABLE 5

| Photosensitive Element | Dmax (B) | Dmin (B) |
|---|---|---|
| (I) (comparison) | 1.86 | 0.10 |
| (II) (this invention) | 2.05 | 0.10 |

From the results shown above, it is understood that the compounds of this invention can increase Dmax without substantially changing Dmin.

While the invention has been described in detail and with reference to specific embodiments thereof, it will be apparent to one skilled in the art that various changes and modifications can be made therein without departing from the spirit and scope thereof.

What is claimed is:

1. An internal latent image type direct positive silver halide photographic emulsion, said emulsion containing a fogging agent which acts during development or pre-bath processing to preferentially form surface development nuclei, said emulsion containing at least one sensitizing dye selected from the group consisting of dyes represented by formula I and at least one compound selected from the group consisting of compounds represented by general formula II;

Formula I:

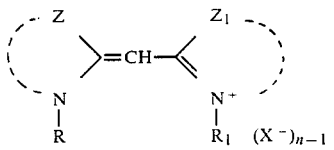

wherein Z and $Z_1$ each represents a non-metallic atomic group necessary for completing a benzoxazole nucleus, benzothiazole nucleus, a benzoselenazole nucleus, a naphthooxazole nucleus, a naphthothiazole nucleus, a naphthoselenazole nucleus, a thiazole nucleus, a thiazoline nucleus, a pyridine nucleus, or a quinoline nucleus; R and $R_1$ each represents an alkyl group, a substituted alkyl group, or an allyl group; $X^-$ represents an acid anion; and n represents 1 or 2:

Formula II:

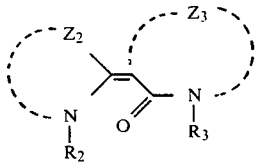

wherein $Z_2$ represents a non-metallic atomic group necessary for completing a thiazole nucleus, a thiazoline nucleus, a selenazole nucleus, a selenazoline nucleus, or a pyrrolidine nucleus; $Z_3$ represents a non-metallic atomic group necessary for completing a rhodanine nucleus, a 2-thiohydantoin nucleus, a 2-thiooxazolidine-2,4-dione nucleus, or a 2-thioselenazolidine-2,4-dione nucleus; and $R_2$ and $R_3$ each represents a hydrogen atom, an alkyl group, a substituted alkyl group, an aromatic group, or an allyl group.

2. A direct positive silver halide photographic emulsion as claimed in claim 1, wherein said sensitizing dye is contained in an amount of from $1.0\times10^{-5}$ to $5\times10^{-4}$ mole per mole of silver halide.

3. A direct positive silver halide photographic emulsion as claimed in claim 1, wherein said compound is contained in an amount of from $1.0\times10^{-5}$ to $5\times10^{-4}$ mole per mole of silver halide.

4. A direct positive silver halide photographic emulsion as claimed in claim 1 wherein the molar ratio of the amount of said sensitizing dye to the amount of said compound is 1/10 to 10.

5. A direct positive silver halide photographic emulsion as claimed in claim 1 wherein the emulsion contains the fogging agent in an amount of from 50 to 15,000 mg per mole of Ag.

6. A direct positive silver halide photographic emulsion as claimed in claim 1, wherein the emulsion further contains a dye image-forming coupler.

7. A direct positive silver halide photographic emulsion as claimed in claim 1, wherein the emulsion further contains a developing agent.

8. A photographic material for obtaining a direct positive image by the application of surface development in the presence of a fogging agent after image exposure, comprising a support having thereon at least one layer of an internal latent image type silver halide emulsion containing at least one sensitizing dye selected from the group consisting of dyes represented by general formula I, and at least one compound selected from the group consisting of compounds represented by general formula II;

Formula I:

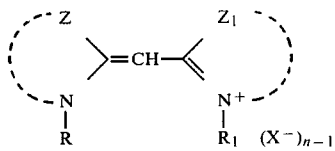

wherein Z and $Z_1$ each represents a non-metallic atomic group necessary for completing a benzoxazole nucleus, a benzothiazole nucleus, a benzoselenazole nucleus, a naphthooxazole nucleus, a naphthothiazole nucleus, a naphthoselenazole nucleus, a thiazole nucleus, a thiazoline nucleus, a pyridine nucleus, or a quinoline nucleus; R and $R_1$ each represents an alkyl group, a substituted alkyl group, or an allyl group; $X^-$ represents an acid anion; and n represents 1 or 2:

Formula II:

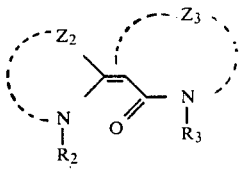

wherein $Z_2$ represents a non-metallic atomic group necessary for completing a thiazole nucleus, a thiazoline nucleus, a selenazole nucleus, a selenazoline nucleus, or a pyrrolidine nucleus; $Z_3$ represents a non-metallic atomic group necessary for completing a rhodanine nucleus, a 2-thiohydantoin nucleus, a 2-thiooxazolidine-2,4-dione nucleus, or a 2-thioselenazolidine-2,4-dione nucleus; and $R_2$ and $R_3$ each represents a hydrogen atom, an alkyl group, a substituted alkyl group, an aromatic group, or an allyl group, said photographic material containing a fogging agent which acts during development or pre-bath processing to preferentially form surface development nuclei.

9. A diffusion transfer photographic material comprising a photosensitive unit comprising a layer of an internal latent image type silver halide emulsion associated with a non-diffusible dye image-providing material capable of releasing a diffusible dye in proportion to the amount of developed silver in said silver halide emulsion layer, and a dyeing layer for receiving said diffusible dye, and a processing composition unit for processing the photosensitive unit, said internal latent image type silver halide emulsion containing at least one sensitizing dye selected from the group consisting of dyes represented by general formula I and at least one compound selected from the group consisting of compounds represented by general formula II;

Formula I:

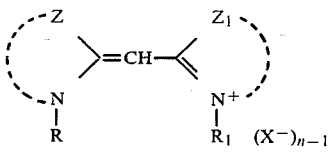

wherein Z and $Z_1$ each represents a non-metallic atomic group necessary for completing a benzoxazole nucleus, a benzothiazole nucleus, a benzoselenazole nucleus, a naphthooxazole nucleus, a naphthothiazole nucleus, a naphthoselenazole nucleus, a thiazole nucleus, a thiazoline nucleus, a pyridine nucleus, or a quinoline nucleus; R and $R_1$ each represents an alkyl group, a substituted alkyl group, or an allyl group; $X^-$ represents an acid anion; and n represents 1 or 2:

Formula II:

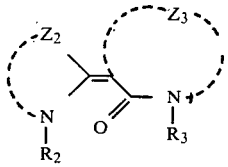

wherein $Z_2$ represents a non-metallic atomic group ncessary for completing a thiazole nucleus, a thiazoline nucleus, a selenazole nucleus, a selenazoline nucleus, or a pyrrolidine nucleus; $Z_3$ represents a non-metallic atomic group necessary for completing a rhodanine nucleus, a 2-thiohydantoin nucleus, a 2-thiooxazolidine-2,4-dione nucleus, or a 2-thioselenazolidine-2,4-dione nucleus; and $R_2$ and $R_3$ each represents a hydrogen atom, an alkyl group, a substituted alkyl group, an aromatic group, or an allyl group, said photographic material containing a fogging agent which acts during development or pre-bath processing to preferentially form surface development nuclei.

10. The photographic material of claim 8 wherein the fogging agent is contained in the internal latent image type silver halide emulsion.

11. The photographic material of claim 9 wherein the fogging agent is contained in the internal latent image type silver halide emulsion.

12. A direct positive silver halide photographic emulsion as claimed in claim 1 wherein the development is with an alkaline developer.

13. A photographic material as claimed in claim 8 wherein the development is with an alkaline developer.

14. A photographic material as claimed in claim 9 wherein development is with an alkaline developer.

15. A direct positive silver halide photographic emulsion as claimed in claim 12 wherein the developer has a pH of 10–13.

16. A photographic material as claimed in claim 13 wherein the developer has a pH of 10–13.

17. A photographic material as claimed in claim 14 wherein the developer has a pH of 10–13.

18. A direct positive silver halide photographic emulsion as claimed in claim 1 wherein the at least one sensitizing dye represented by formula I and the at least one compound selected from the group consisting of compounds represented by general formula II result in a high maximum density and low minimum density.

19. A photographic material as claimed in claim 8 wherein the at least one sensitizing dye represented by formula I and the at least one compound selected from the group consisting of compounds represented by general formula II result in a high maximum density and low minimum density.

20. A photographic material as claimed in claim 9 wherein the at least one sensitizing dye represented by formula I and the at least one compound selected from the group consisting of compounds represented by general formula II result in a high maximum density and low minimum density.

21. A photographic material as claimed in claim 8, wherein said sensitizing dye is contained in an amount of from $1.0\times10^{-5}$ to $5\times10^{-4}$ mole per mole of silver halide.

22. A photographic material as claimed in claim 8, wherein said compound is contained in an amount of from about $1.0\times10^{-5}$ to $5\times10^{-4}$ mole per mole silver halide.

23. A direct positive silver halide photographic emulsion as claimed in claim 8, wherein the molar ratio of the amount of said sensitizing dye to the amount of said compound is 1/10 to 10.

24. A photographic material as claimed in claim 8, wherein the emulsion contains the fogging agent in an amount of from 50 to 15,000 mg per mole of Ag.

25. A photographic material as claimed in claim 8, wherein the emulsion further contains a dye image forming coupler.

26. A diffusion transfer photographic material as claimed in claim 9, wherein said sensitizing dye is contained in an amount of from $1.0\times10^{-5}$ to $5\times10^{-4}$ mole per mole of silver halide.

27. A diffusion ltransfer photographic material as claimed in claim 9, wherein said compound is contained in an amount of from $1.0\times10^{-5}$ to $5\times10^{-4}$ mole per mole silver halide.

28. A diffusion transfer photographic material as claimed in claim 9, wherein the molar ratio of the amount of said sensitizing dye to the amount of said compound is 1/10 to 10.

29. A diffusion transfer photographic material as claimed in claim 9, wherein the emulsion contains the fogging agent in an amount of from 50 to 15,000 mg per mole of Ag.

30. A diffusion transfer photographic material as claimed in claim 9, wherein the emulsion further contains a dye image forming coupler.

* * * * *